US009508327B2

(12) United States Patent
Jackson

(10) Patent No.: US 9,508,327 B2
(45) Date of Patent: Nov. 29, 2016

(54) PITCH ADJUSTMENT DEVICE FOR STRINGED MUSICAL INSTRUMENTS

(71) Applicant: David H. Jackson, Dahlonega, GA (US)

(72) Inventor: David H. Jackson, Dahlonega, GA (US)

( * ) Notice: Subject to any disclaimer, the term of this patent is extended or adjusted under 35 U.S.C. 154(b) by 0 days.

(21) Appl. No.: 15/082,972

(22) Filed: Mar. 28, 2016

(65) Prior Publication Data

US 2016/0260420 A1 Sep. 8, 2016

Related U.S. Application Data

(63) Continuation-in-part of application No. 14/640,693, filed on Mar. 6, 2015, now Pat. No. 9,299,323.

(51) Int. Cl.
*G10D 3/14* (2006.01)
*G10D 3/04* (2006.01)

(52) U.S. Cl.
CPC . *G10D 3/14* (2013.01); *G10D 3/04* (2013.01)

(58) Field of Classification Search
CPC ..... G10D 3/143; G10D 3/14; G10D 3/146; G10D 3/04
See application file for complete search history.

(56) References Cited

U.S. PATENT DOCUMENTS 2,323,969 A * 7/1943 Biederman ..... G10D 3/143 24/68 CT
2,603,119 A * 7/1952 Dearth ..... G10D 3/143 84/312 R
2,844,985 A 7/1958 Ferriera
2,949,806 A * 8/1960 Turman ..... G10D 3/146 84/297 R
2,998,742 A 9/1961 Pratt
3,248,991 A * 5/1966 Cole ..... G10D 3/12 84/313
3,390,600 A 7/1968 Kelly, Jr.
3,479,917 A 11/1969 Zitnik, Jr. et al.
3,688,631 A 9/1972 Jackson
4,080,864 A 3/1978 Jackson
4,080,865 A * 3/1978 Gfell ..... G10D 3/143 84/297 R
4,170,161 A * 10/1979 Kaftan ..... G10D 3/143 84/297 R
4,457,201 A 7/1984 Storey
4,535,670 A 8/1985 Borisoff
4,742,750 A 5/1988 Storey
5,140,884 A 8/1992 Bowden
5,323,680 A 6/1994 Miller et al.
5,438,902 A 8/1995 Baker
5,542,330 A 8/1996 Borisoff
5,567,897 A 10/1996 McEwen (Continued)

OTHER PUBLICATIONS http://duesenberg.de/en/guitars/specials/pomona-6-lapsteel.html.

(Continued)

*Primary Examiner* — Robert W Horn
(74) *Attorney, Agent, or Firm* — Vista IP Law Group LLP

(57) ABSTRACT

A pitch adjustment device for selectively adjusting the pitch of at least one of a plurality of strings on a stringed musical instrument. The device comprises a support frame configured to be mounted onto the stringed musical instrument. A string puller is rotatably coupled to the support frame. A string support is coupled to the string puller. The string support is adjustably positionable along the string puller to selectively position the string support on the string puller in alignment with each of the strings one at a time. The string support also has a string retainer for securing a string. A lever is coupled to the string puller such that pivoting the lever rotates the string puller and the string support relative to the frame about the first axis. The lever has a normal position and an actuated position in which the lever is pivoted to adjust the pitch.

24 Claims, 9 Drawing Sheets

(56) References Cited

U.S. PATENT DOCUMENTS

| | | | | |
|---|---|---|---|---|
| 5,585,580 | A | 12/1996 | Higgins | |
| 5,739,444 | A | 4/1998 | Borisoff | |
| 5,796,020 | A * | 8/1998 | Truitt | G10D 3/143 84/264 |
| 5,986,190 | A | 11/1999 | Wolff et al. | |
| 7,247,779 | B2 | 7/2007 | Zumsteg | |
| 7,329,808 | B2 * | 2/2008 | Davis | G10D 3/143 84/298 |
| 7,465,860 | B2 | 12/2008 | Jackson | |
| 7,645,927 | B1 | 1/2010 | Jackson | |
| 7,696,420 | B2 | 4/2010 | Thompson | |
| 7,759,568 | B2 | 7/2010 | Jackson | |
| 8,044,287 | B2 | 10/2011 | Jackson | |
| 9,251,768 | B2 * | 2/2016 | Lionello | G10D 3/143 |
| 9,299,323 | B1 * | 3/2016 | Jackson | G10D 1/08 |
| 9,324,308 | B1 * | 4/2016 | Clarke | G10D 3/143 |
| 9,330,639 | B1 * | 5/2016 | Armstrong | G10D 3/146 |
| 9,424,820 | B2 * | 8/2016 | Jackson | G10D 3/143 |
| 2016/0260420 | A1 * | 9/2016 | Jackson | G10D 3/04 |

OTHER PUBLICATIONS http://www.tremorbender.com/.
http://www.bowdenbbenders.com/.

* cited by examiner

PITCH ADJUSTMENT DEVICE FOR STRINGED MUSICAL INSTRUMENTS

RELATED APPLICATIONS

This application is a continuation-in-part of U.S. patent application Ser. No. 14/640,693, filed Mar. 6, 2015, now U.S. Pat. No. 9,299,323, issued Mar. 29, 2016, Priority to the aforementioned application is hereby expressly claimed in accordance with 35 U.S.C. Section 119(e), 120, and any other applicable laws. The aforementioned application is hereby incorporated by reference herein in its entirety.

FIELD OF THE INVENTION

The field of the invention generally relates to stringed musical instruments, and more particularly to a device for selectively adjusting the tension (and therefore pitch) of the strings of such musical instruments while the instrument is being played.

BACKGROUND OF THE INVENTION

In general, stringed musical instruments commonly comprise a body having a first end with a support for attaching one end of the strings, a second end having a support for attaching the other end of the strings and a tuning apparatus for adjusting the tension, and thus the pitch, of each of the strings. As one example, a steel guitar is a generally horizontally mounted guitar having a head end and a tail end and a plurality of strings extending therebetween. The head end is provided with a plurality of tuning keys (one for each string) to which one end of a string is secured. The tuning keys allow manual adjustment of the pitch of each string to tune the guitar. The other end of the string is secured to a bridge at the tail end of the guitar.

In addition, stringed instruments such as guitar, steel guitars, and the like, typically have more than one possible tuning. A "tuning" of a stringed instruments means the pitches assigned to the open pitch (the fundamental pitch of the properly tuned, unstopped, full string) of each of the strings on the stringed instruments. For example, the standard tuning, which is the most common tuning, of a standard, six string guitar, from lowest pitch string (top string in standard orientation of guitar) to highest pitch string (bottom string) string is E-A-D-G-B-E. However, there are a number of "alternate" tunings. For example, "drop tunings" begin with the standard tuning and then lowers ("drops") the pitch of only a single string, or in rare cases, two strings. The dropped stringed is usually the lowest pitched (E) string, such as in the "drop D tuning" in which the lowest string is tuned down a whole step to a low D. Other alternate tunings are referred to as "open tunings" in which the open pitch of all six strings play a chord. For instance, the major open tunings give a major chord with the open strings, such as "Open A," "Open B," etc.

Steel guitars are generally not tuned in standard guitar tuning, but instead are tuned to an open chord, and have many, many popular tunings. The most common 6-string steel guitar tuning is the C6 tuning, which in itself has no "standard", but rather has a number of variations. One popular C6 tuning is C-E-G-A-C-E, from lowest pitch (closest to the musician in the standard playing position) to highest pitch (furthest from the musician). All tunings shown herein are from lowest pitch to highest pitch, i.e. from thickest string to thinnest string. Several alternate tunings for steel guitar include: Open E tuning -E-B-E-G#-B-E; Open A tuning -E-A-E-A-C#-E; Open G tuning -D-G-D-G-B-D; to name a few among many more.

In the course of playing certain stringed instruments, in particular a steel guitar, a musician may desire to produce characteristic effects, and/or change the overall tuning of the instrument, by changing the pitch of one or more selected strings by adjusting the tension of the particular string(s), rather than by modifying the vibrating length of the string(s) by "fingering" on a fret board or placing a movable slide (or "tone bar" or "fret bar") along the string(s). Changing the pitch of just selected strings allows the musician to expand the amount of tonal and chordal variation available to the musician in playing the stringed instrument.

While the tuning keys provide for relatively convenient tuning of the "open pitch" (the fundamental pitch of the properly tuned, unstopped, full string) of each string, musicians often desire to modify the open pitch of one or more strings while playing the instrument. The tuning keys are not convenient for adjusting the pitch of a string while playing for a variety of reasons. For one, the keys are not located in a convenient location for the musician to adjust manually because the musician is generally using both hands to play the instruments, with one hand strumming or plucking the strings and the other hand manipulates the strings to adjust their pitch to form desired tones. In addition, the tuning keys do not allow for a calibrated or consistent adjustment of pitch to an adjusted pitch, or consistent return to the original open pitch, but instead both changes in pitch vary with the amount of manual rotation of the key which is inherently imprecise as it depends on the manual precision of the musician.

In the past, various pitch adjusting mechanisms for adjusting the pitch of select strings of a stringed musical instruments while playing the instrument have been proposed. These pitch adjusting mechanisms generally operate by selectively increasing or decreasing the tension or pitch of a string by moving one of the secured ends of the string to either decrease the vibrating length of the string (which increases the tension and raises the pitch) or increase the vibrating length of the string (which decreases the tension and lowers the pitch). Although not limited to steel guitars, these types of pitch adjusting mechanisms have found widespread application on steel guitars.

Typical examples of pitch adjusting mechanisms for adjusting the pitch of strings on string instruments while playing, such as a steel guitar, are found in U.S. Pat. Nos. 3,688,631 and 3,390,600. These patents are expressly incorporated by reference herein in their entireties. Each of these patents discloses a pitch adjusting mechanism for adjusting the pitch of an individual string both upwardly or downwardly. The mechanisms in both of these two patents also have in common that the pitch adjusting mechanism is provided at the bridge end of the strings and the mechanisms comprise relatively complicated systems of levers, springs and linkages. In order to provide for both raising and lowering the pitch of the string with a single lever attached to the string, these mechanisms provide for a system which allows the single lever to be selectively actuated in both directions, i.e. clockwise and counter-clockwise, and also provide a means for returning the string to the open tune position (this means the normal pitch of the string without actuation of the pitch adjusting mechanism) upon de-actuation. Accordingly, the springs and lever arms of each of the parts of these mechanisms must be delicately balanced to provide proper operation and to minimize or avoid mistuning.

However, none of the prior pitch adjusting mechanisms allow for a simple, individually operated actuator which can adjust the pitch of multiple strings each by differing and modifiable amounts. In other words, none of the prior devices provide a simple mechanism which can adjust a first string by one amount which is modifiable, and another string by a different amount which is independently modifiable from the first string, by the operation of a single actuator, such as a single lever or pedal. For example, adjusting a steel guitar from one tuning to a different tuning may require adjusting one string a whole tone, while adjusting another string by a half tone (the term "note" is used interchangeably herein with the term "tone" when referring to the musical scale).

Therefore, there is need for a pitch adjustment device for stringed instruments which overcomes the problems associated with prior devices.

SUMMARY OF THE INVENTION

The present invention is directed to innovative pitch adjustment devices (also referred to as an apparatus) for selectively adjusting the pitch of one or more strings of a stringed musical instrument from the open pitch (normal unadjusted pitch) while playing using a lever (typically hand operated).

In one embodiment of a pitch adjustment apparatus of the present invention, the length of different strings (and thus tension and pitch) can be adjusted by different and adjustable amounts for each adjustable string. Accordingly, the device allows a musician to adjust the pitch of two or more strings, wherein the amount of pitch adjustment of each string can be adjustably preset independent of the other strings. In other words, a first string can be preset to adjust the pitch of the first string from the open position to an adjusted pitch which is a whole tone different from its open tone, while a second string is preset to adjust the pitch of the second string from the open position to an adjusted pitch which is a half tone different from its open tone, with both strings being adjusted by a single actuation of a single lever. The device provides for very stable and consistent pitch in the adjusted and open pitch of each string, while also providing relatively simple tuning adjustment for each pitch position. In other words, it is a straightforward and simple task to tune each string to provide the desired open pitch, and the adjusted pitch in the actuated position.

Accordingly, in a first embodiment, the pitch adjustment device comprises a support frame configured to be mounted onto a stringed musical instrument. For instance, in the case of a use on a steel guitar, the support frame is configured to be mounted to the top of the body or frame of the steel guitar. The support frame may be configured to function as the bridge located at the tail end of a steel guitar, for example. The pitch adjustment device further comprises a string puller rotatably coupled to the support frame and rotatable about an axis of rotation (e.g., a first axis). Typically, the axis of rotation of the string puller is configured to be substantially transverse to the longitudinal axis of the strings of the musical instrument, when the device is mounted on the stringed instrument.

At least two pitch adjusters are attached to the string puller at spaced apart locations such that each pitch adjuster rotates with the rotation of the string puller. One pitch adjuster is provided for each string which will have its pitch adjusted by the device (referred to as an "adjustable string"). Thus, two pitch adjusters are provided to adjust two strings, three pitch adjusters are provided to adjust three strings, and so on. Typically, each pitch adjuster is located on the string puller in alignment with the respective string which it will adjust. The strings which do not have their pitch adjusted by the device, if any, are fixed in place, such as attached to a fixed bridge portion of the frame.

Each pitch adjuster has a string support for securing a respective adjustable string of the stringed instrument at a respective string position for each pitch adjuster. Each pitch adjuster is adjustable to adjust the respective string support to a plurality of different radial positions from the first axis. Said another way, each pitch adjuster can vary the radial distance of the string support, and therefore the tail end of the string, from the first axis. Accordingly, the distance traveled by the string support for a given rotation of the string puller is proportional to the radial distance of the string support from the first axis. Hence, for a given rotation of the string puller, a first pitch adjuster having its string support at a first radius will modify the length of its respective string by a greater amount than a different pitch adjuster having its string support at a second radius smaller than the first radius.

A lever is coupled to the string puller such that pivoting the lever rotates the string puller relative to the frame about the first axis. The lever is typically attached to one end of the string puller and is located near the palm of the musician and oriented longitudinally substantially parallel to the strings when the device is mounted on the instrument. The lever has a normal position in which the lever is not being actuated (i.e., the adjustable strings are in the open pitch) and an actuated position in which the lever is pivoted in a first direction from the normal position (i.e., the adjustable strings are in an adjusted pitch).

The operation and use of the pitch adjustment device is fairly straightforward. The pitch adjustment device is mounted to a stringed instrument, such as at the tail end of a steel guitar. The tail end of the adjustable strings are secured to the string supports of their respective string adjusters. With the lever in the normal position (typically, the lever is biased to the normal position by the string tension and/or counterbalancing springs), the instrument is tuned to the open tuning with each string tuned to its open pitch. Then, the lever is actuated by pivoting the lever in the first direction (usually downward) to the actuated position. The adjustable strings are then tuned to the desired adjusted pitch by adjusting the string adjusters thereby adjusting the radial distance of the string supports. As explained above, the amount of pitch adjustment applied by each pitch adjuster to its respective string can vary from one adjustable string to another.

The pitch adjustment device can then be utilized by a player while playing the instrument. To play the instrument with the adjustable strings in their open pitch, the player simply leaves the lever in the normal position. When the player desires to modify the pitch of the adjustable strings, such as to change the tuning of the instrument from one key to a different key, the player actuates the lever to the actuated position by pivoting the lever in the first direction which rotates the string puller, the pitch adjusters, the string supports and the tail end of the adjustable strings, thereby modifying the length, and thus the tension and pitch, of the adjustable strings. When the player desires to return to the open tuning of the instrument, the player releases the lever, and the biasing force pivots the lever back to the normal position which in turn rotates the string puller, the pitch adjusters, the string supports and the tail end of the adjustable strings to their unadjusted position for the open tuning of the instrument.

In another aspect, the pitch adjustment device may further comprise an adjustable open stop for setting the position of the lever in the normal position, and/or an adjustable actuation stop for setting the actuated position of the lever at which the pivoting motion of the lever is limited (i.e. stopped).

In still another aspect, the string puller may comprise an elongated shaft having a pair of circular bearing surfaces, one on each end of the shaft. Each circular bearing surface is received in a respective circular hole in the support frame. The string puller may then rotate about the first axis by the circular bearing surface rotating relative to the respective circular holes in the support frame.

In an alternative aspect, the string puller may comprise a substantially flat, elongated plate. The plate has a plurality of pivot members, such as one on each end of the plate which bear against a respective pivot surface on the support frame such that the first axis is defined by the interface of the pivot members and the respective pivot surfaces. For instance, the pivot members may be sharp or knife edges which bear against their respective pivot surfaces such as an arcuate wall of the frame member.

In still another aspect, the pitch adjusters may each comprise a screw threadingly attached to a respective threaded hole in the string puller. In such case, the radial position of the string support can be adjusted by turning the screw.

In another feature of the present invention, the pitch adjusting device may further comprise one or more counterbalancing springs coupled to one of the string puller or the lever and configured to bias the rotation of the string puller against the tension of the strings when secured to the string supports.

In yet another aspect, a releasable locking device may be provided to releasably lock the lever in the actuated position. For example, the releasable locking device may be any suitable latch, magnets, fastener, detent, cam follower, pen click type mechanism, etc., for releasably locking the lever in the actuated position. If the adjustable open stop and/or an adjustable actuation stop for setting stops are installed on the bottom of the instrument, which is the case on certain designs, the lever can be independently adjusted, heightwise. Screws will adjust the height of the lever up or down, without effecting the position of the shaft. In others words, the player will not have to retune if the player adjusts the height of the lever.

In yet another feature, the device of the present invention may comprise two of the pitch adjusting devices as described above. Each pitch adjusting device includes each of the features described above, and are configured such that the axis of rotation of one of the string puller or one of the pitch adjusters is spaced apart from the axis of rotation of the string puller of the other pitch adjuster. In addition, the lever of one of the devices may be on the opposite side of the lever of the other pitch adjuster, so that one lever is located on one side of the strings of the stringed instrument and the other lever is located on the opposite side of the strings. Then, certain string(s) are secured to string support(s) on one of the device and different string(s) are secured to string support(s) on the other device. Then, after tuning both devices as described above, any combination of none, one or both devices can be actuated while playing to obtain a desired tuning of the instrument.

In a second embodiment of the present invention, a pitch adjustment device is configured to utilize an innovative and adjustably positionable string support having a string friendly configuration which reduces the stresses on the strings and reduces string breakage, especially with regard to the thinner, higher pitch strings. Similar to the pitch adjustment device described above, this embodiment comprises a frame configured to be mounted to the stringed musical instrument, such as the body of an electric guitar such as a conventional electric guitar (e.g., a FENDER™ style electric guitar), a steel guitar, or other suitable stringed instrument. The support frame may include a bridge which supports each of the strings and functions to establish the bridge end of each string (the tail end of the vibrating and tone producing length of each string). A string puller is rotatably coupled to the support frame and is rotatable about a first axis of rotation. Generally, the first axis is configured to be substantially transverse to a longitudinal axis of the strings of the musical instrument. The string puller has a longitudinal axis which extends substantially transverse to the longitudinal axis of each of the strings of the stringed musical instrument. The first axis and the longitudinal axis are typically parallel and may be collinear.

A string support is coupled to the string puller such that it rotates with rotation of the string puller. The string support is adjustably positionable along the longitudinal axis of the string puller to selectively position the string support on the string puller in corresponding alignment with each of the strings one at a time. In other words, the string support can be positioned in alignment with every one of the strings, but one at time. Thus, the string support is positioned in alignment with a selected string and the pitch of the selected string will be adjustable using the pitch adjustment device, as described herein. The string support has a string retainer for securing a tail end of a selected string to the string support.

A lever is coupled to the string puller such that pivoting the lever rotates the string puller and the string support. Typically, the lever is attached to one end of the string puller and is located near the palm of the musician and oriented longitudinally substantially parallel to the strings when the device is mounted on the instrument. The lever has a normal position in which the lever is not being actuated (i.e., the adjustable strings are in the open pitch) and an actuated position in which the lever is pivoted in a first direction from the normal position (i.e., the adjustable strings are in an adjusted pitch).

The set-up and use of this second embodiment of pitch adjustment device is relatively simple. The pitch adjustment device is mounted to a stringed instruments, such as by mounting the support frame to the body of a guitar using suitable fasteners such as screws or bolts. For a retrofit installation, the original bridge and/or pickup may be removed, and then the pitch adjustment device can be mounted in place of the original bridge and/or pickup. The mounting holes of the support frame can be configured to match the mounting holes of the original bridge and/or pickup so that no additional holes in the body are required.

The string support is then positioned in alignment with a selected one of the strings, which string will be adjustable using the pitch adjustment device. The string support is then secured in place, for example, using a set screw extending through the string support and securing to the string puller. The adjustable string is positioned on the bridge and the tail end of the adjustable string is secured to the string retainer The respective tail end of each of the other strings is secured to a string holder having slots or other fastening devices for securing the tail end of the other strings.

With the lever in the normal position (the lever is biased to the normal position by the string tension and/or counterbalancing springs), the instrument is tuned to a desired open tuning with each string tuned to its open pitch. Then, the lever is actuated by pivoting the lever in a first direction (usually downward) to the actuated position which adjusts the pitch of the adjustable string. An adjustable actuation stop may be provided which limits the pivoting of the lever in the first direction and which is adjustable to adjust the actuated position at which the pivoting motion of the lever is limited. The adjustable actuation stop can be adjusted to tune the adjustable string to the desired pitch with the lever in the actuated position (i.e., pivoted to the limit of the actuation stop).

The pitch adjustment device can then be utilized by a player playing a stringed instrument. When the open pitch of all strings is desired, the player simply leaves the lever in the normal position. When the player desires to modify the pitch of the adjustable string, such as to change the tuning of the instrument from one key to a different key, the player actuates the lever to the actuated position by pivoting the lever in the first direction which rotates the string puller, the string support and the tail end of the adjustable string, thereby modifying the length, and thus the tension and pitch, of the adjustable string. When the player desires to return to the open tuning of the instrument, the player releases the lever, and the biasing force pivots the lever back to the normal position which also rotates the string puller, the string support and the tail end of the adjustable string to their unadjusted, normal position for the open tuning of the instrument.

In another feature of the present invention, the string support of the second embodiment may be configured for use with the first embodiment. One or more of the pitch adjusters in the first embodiment may be left off the device, and a string support of the second embodiment is coupled to the string puller of the first embodiment such that string support is adjustably positionable along the longitudinal axis of the string puller. The resulting pitch adjustment device may then be set-up and utilized as described above. One or more first selected strings may be secured to a string support of a pitch adjuster, and a second selected string is secured to the string support of the second embodiment. The first selected strings may then be tuned using the procedure described for the first embodiment, and the second selected string may be tuned using the procedure described for the second embodiment. The pitch adjustment device is utilized by a player while playing as described for either one of the first and/or second embodiments.

In another aspect of the second embodiment, the string support may comprise a first string contact surface disposed vertically below the first axis. The first string contact surface has a cross-section substantially in the shape of a circular arc rotated about the first axis. The first string contact surface is configured to be the part of the string support which first contacts and supports the tail end of the adjustable string as the string extends from the bridge to the string support. The first string contact surface is below the first axis of rotation of the string puller such that rotation of the string support (and lever) in the first direction increases the tension and thus, the pitch, of the adjustable string. The adjustable string is positioned on the first string contact surface (on the bottom of the string support) for a "raise" adjustment using the string adjustment device. In other words, actuating the lever from the normal position to the actuated position raises the pitch of the adjustable string.

In still another aspect of the second embodiment, the string support may comprise a second string contact surface disposed vertically above the first axis. The second string contact surface also has a cross-section substantially in the shape of a circular arc rotated about the first axis. The second string contact surface is below the first axis of rotation of the string puller such that rotation of the string support (and lever) in the first direction decreases the tension and thus, the pitch, of the adjustable string. The second string contact surface is configured to be the part of the string support which first contacts and supports the tail end of the adjustable string as the string extends from the bridge to the string support (in the case that the string adjustment device is used a to provide a "lower" adjustment using the string adjustment device. The adjustable string is positioned on the second string contact surface (on top of the string support) for a "lower" adjustment using the string adjustment device, such that actuating the lever from the normal position to the actuated position raises the pitch of the adjustable string.

In another aspect of the second embodiment, the pitch adjustment device may comprise two or more string supports coupled to the string puller. Each string support has the features as described herein, and is independently, adjustably positionable along the longitudinal axis of the string puller. In this way, each string support is positioned in alignment with a respective, selected string, such that multiple strings may be adjustable using the pitch adjustment device.

Additional aspects and features of the pitch adjustment device and related mechanisms of the present invention will become apparent from the drawings and detailed description provided below.

BRIEF DESCRIPTION OF THE DRAWINGS

The invention is illustrated by way of example and not limitation in the figures of the accompanying drawings, in which like reference numbers refer to similar elements, and in which.

DETAILED DESCRIPTION OF THE INVENTION

Figure 1:
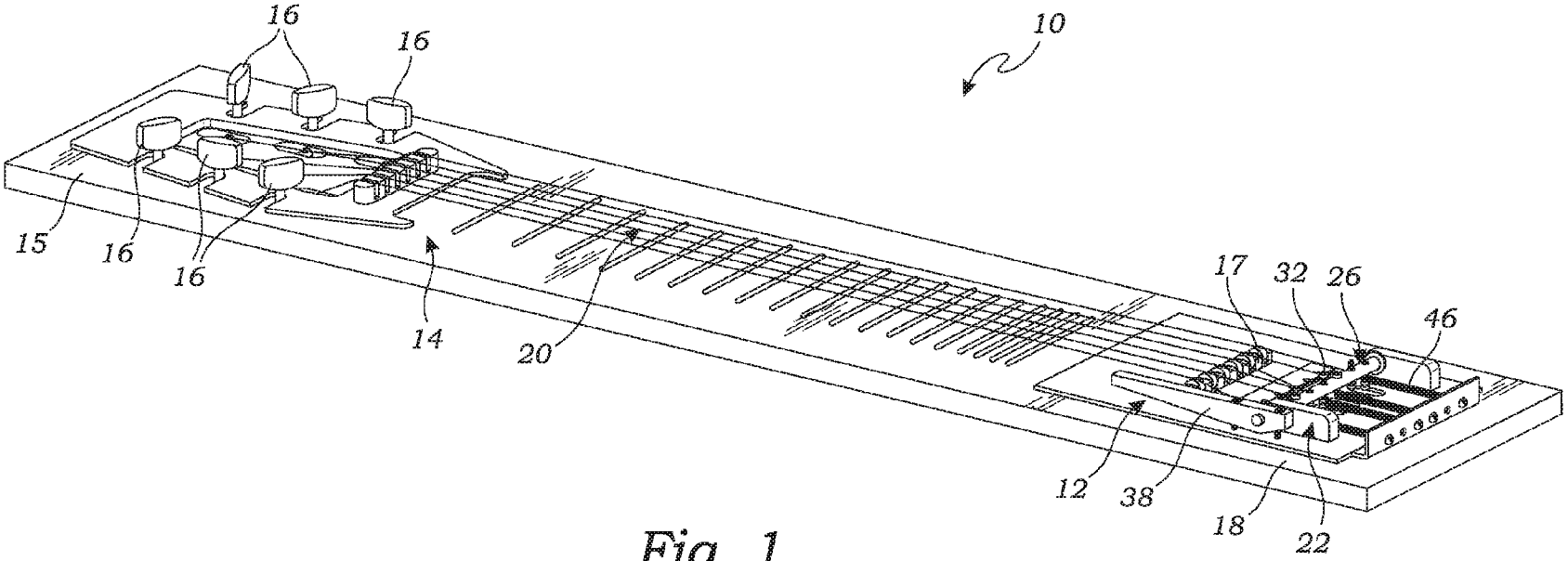
FIG. 1 is a side perspective view of an exemplary steel guitar having a pitch adjustment device, according to one embodiment of the present invention.

Referring to FIG. 1, a first embodiment of the pitch adjustment device 12 of the present invention will be described in connection with an exemplary instrument, in this case a steel guitar 10. It should be understood that any of the pitch adjustment devices 12, and other related features are not limited to a steel guitar 10 as shown and described, but can be applied to any stringed instrument. Therefore, the present invention is not limited to the embodiment on a steel guitar. Moreover, although the steel guitar 10 is shown with a single neck, it is common for steel guitars to have two necks, a front neck and a rear neck, as shown in U.S. Pat. No. 3,688,631. It should be understood that the present invention can easily be applied to both necks of a dual neck steel guitar.

The steel guitar 10 comprises a body 14 having a head end 15 and a tail end 18, and a plurality of strings 20 (in this example, the steel guitar 10 has 6 strings) generally indicated at 20. The head end of each string 20 is operatively coupled to a respective tuning key 16. The tuning keys 16 are operably attached to a key frame 14, such that each tuning key 16 can rotate relative to the key frame 14 to adjust the tension, and thus pitch, of its string 20. The strings 20 extend rearward from the tuning keys 16 and pass over and are supported by the bridge 17. The tail end of each string 20 is operatively coupled to the pitch adjustment device 12 which is attached to the tail end 18 of the body 14. The pitch adjustment device 12 may be attached to the tail end 18 of the body 14 by any suitable fastening mechanism, such as screws, bolts, press fit, adhesive, bonding, etc. In addition, the individual components of the pitch adjustment device 12 may be individually attached to the body 14, or they may be attached to one or more structural elements which are attached to the body 14.

Figure 2:
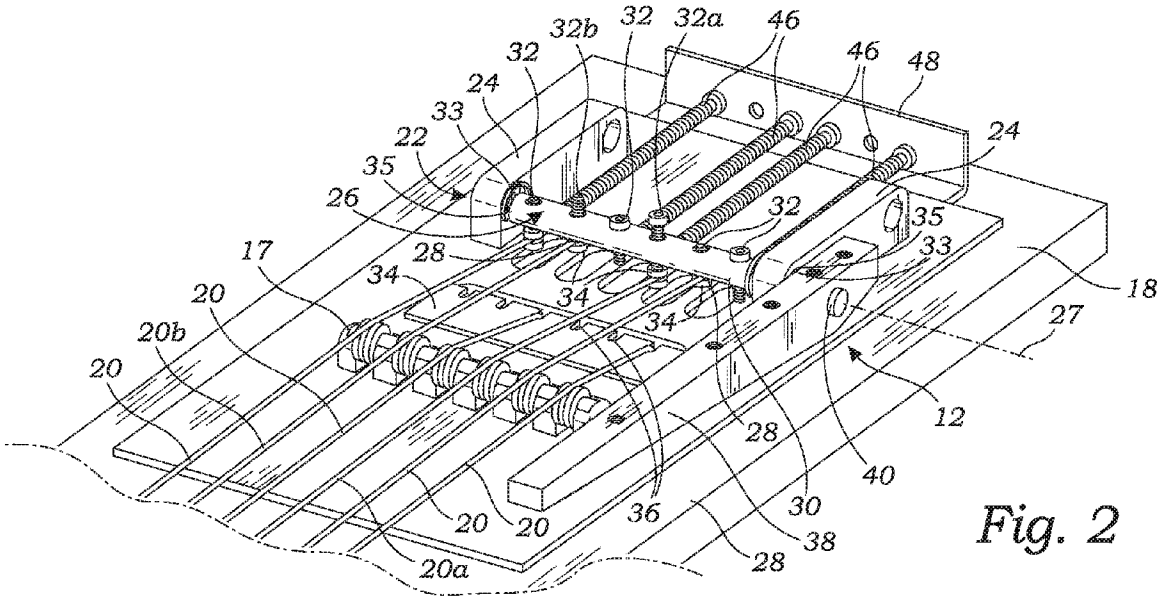
FIG. 2 is an enlarged partial side perspective view of the steel guitar and pitch adjustment device of FIG. 1.
Figure 3:
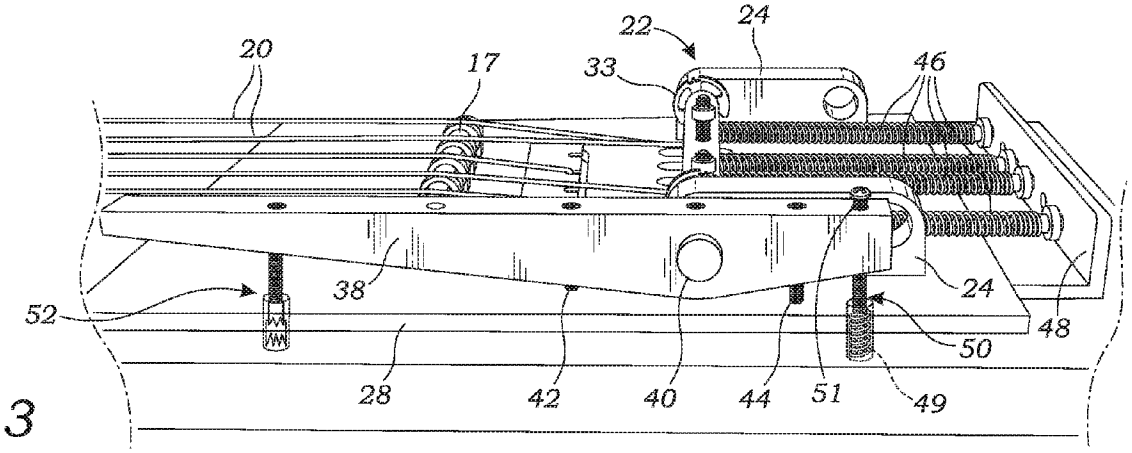
FIG. 3 is an enlarged side view of the steel guitar and pitch adjustment device of FIG. 1.

Turning to FIGS. 2 and 3 showing an enlarged view of the pitch adjustment device 12 and just the tail end 18 of body 14, the pitch adjustment device 12 comprises a support frame 22. The support frame 22 includes a pair of puller mounts 24, one located on the bottom side of the strings 20 and one located on the top side of the strings 20 (the top side of the instrument is the side furthest from the musician while playing the instrument in its normal orientation and the bottom side is the side closest to the musician). The puller mounts 24 extend upward away from the body 14 and are configured to rotatably support a string puller 26. The puller mounts 24 may be attached to a base plate 28 as shown in the embodiment of FIGS. 1-3, or they may be attached directly to the body 14 of the steel guitar 10.

The string puller 26 is rotatably coupled to the puller mounts 24 with one puller mount 24 disposed on each end of the string puller 26. The string puller 26 has a longitudinal first axis 27 about which the string puller 26 rotates and which is substantially transverse to the longitudinal axis of the strings 20.

In the embodiment of FIGS. 1-3, the string puller 26 comprises an elongated, substantially circular shaft 30. The shaft 30 may have a plurality of notches 28 in the bottom surface of the shaft with each notch 28 located in alignment with a respective string 20. The shaft 30 may have any suitable alternative cross-sectional shapes, such as square, rectangular, etc. The string puller 26 has a circular bearing surface 33 on each end of the shaft 30 which is received in a respective circular bearing hole 35 (e.g. bearing race) in the puller mounts 24.

A plurality of adjustable pitch adjusters 32 are attached to the string puller 26 and located in alignment with a respective string 20. The pitch adjusters 32 are threaded screws which are threaded into a mating threaded hole in the shaft 30 of the string puller 26. Each pitch adjuster 32 has a string support 34 configured to secure the tail end of its respective string 20 for which the respective pitch adjuster 32 will adjust the tension and pitch. In the embodiment of FIGS. 1-3, the string support 34 is a pin sized and configured to receive and secure a ball end of the guitar strings 20. For convenience, most guitar strings are provided with a ball having a hole attached to the tail end of the string which can be quickly and easily secured to a pin or slot at the tail end of a guitar.

Each pitch adjuster 32 is attached to the string puller 26 in a substantially vertical orientation, in other words, substantially perpendicular (transverse) to the longitudinal axis of the both the string and first axis. In this position, the pitch adjusters 32 can adjust the length of their respective strings 20 a maximum amount for a given rotation of the string puller in either a clockwise or counterclockwise direction (the direction of rotation referenced facing the bottom end (closest to the musician) of the string puller 26). The pitch adjusters 32 may be attached to the string puller 26 in other suitable orientations, as required by the particular configuration and desired amount of pitch adjustment.

As shown in the example embodiment of FIGS. 1-3, three strings 20 are secured to respective pitch adjusters 32 (the "adjustable strings"), and three strings 20 are not secured to a pitch adjuster 32 (the "non-adjustable strings"). In typical use, a musician will not desire to adjust all strings 20 of an instrument while playing, such as steel guitar 10, but will only want to adjust a few strings, such as two strings, three strings, four strings, or sometimes more for instruments having more than six strings, such as a ten string steel guitar, etc. For the non-adjustable strings 20 (i.e. strings not attached to a pitch adjuster 20), the pitch adjustment device 12 may also include one or more string holders for securing the tail end of the non-adjustable strings 20. For example, in the embodiment of FIGS. 1-3, the pitch adjustment device 12 has a string holder 34 having a plurality of slots 36 for securing the tail end of the strings 20 (e.g. the ball end is simply inserted under the slot 36 with the string 20 extending up through the slot 36).

The pitch adjusters 32 are configured to adjust the amount of pitch adjustment for a given rotation of the string puller 26 by adjusting the radius of the respective string support 34 from the first axis 27. The radius of a string support 34 is easily adjusted by simply turning the screw in the direction to move the string support 34 in the desired direction, either increasing its radius or decreasing its radius. The change in length of a given string 20 (and thus the tension and pitch) caused by the rotation of the pitch adjuster 32 and string support 34 as a result of the rotation of the string puller 26 is determined by distanced the string support 34 move which is related to the radius of the string support 34 from the first axis 27. Accordingly, the amount of length adjustment for an adjustable string 20 can be adjusted by modifying the radial distance of the string support 34 from the first axis 27.

Increasing radial distance increases the amount of adjustment afforded by a pitch adjuster 32 and decreasing the radial distance decreases the amount of adjustment afforded by a pitch adjuster 32, for a given rotation of the string puller 26. Therefore, the pitch adjuster 32*a* having its string support 34 at a first radius will modify the length of its respective string 20 by a greater amount than pitch adjuster 32*b* having its string support at a second smaller radius, and vice versa. Thus, the pitch adjustment device 12 allows different strings to be adjusted by different and adjustable amounts by the rotation of a single string puller 26 which is actuated by a single lever as described below. It is to be understood that the pitch adjusters 26 may have alternative configurations to the screw for supporting and adjustably moving the string support 34, such as a rod and detents, a rod and a ratcheting catch, etc.

Each pitch adjuster 32 may also be configured to either increase the length of its respective adjustable string 20 (i.e. increase the tension and pitch) or decrease the length of its respective adjustable string 20, for a given actuation rotation of the string puller 26 (e.g. the embodiment of FIGS. 1-3 is configured for a counterclockwise actuation rotation). In order to increase the actuated length, the string support 34 is positioned below the string puller 26 and to decrease the actuated length, the string support 34 is positioned above the string puller 26. For a clockwise actuation rotation, the opposite is the case.

A lever 38 is coupled to the string puller 26 for actuating the string puller 26 by pivoting the lever which rotates the string puller 26 about the first axis relative to support frame 22. The lever 38 is attached to the bottom end of the string puller 26, such as by an extension of the bearing surface 33 being received in a circular hole 40 in the lever 38. The lever 38 is positioned near the location where the palm of a musician would be while playing the instrument with an extension part extending from the connection to the string puller 26 substantially parallel to the strings 20. The lever 38 is shown in it normal position (un-actuated) and is actuated by pushing down on the extension part of the lever 38 causing the lever 38 to pivot in a counterclockwise direction to its actuated position, thereby causing the string puller 26, pitch adjusters 32 and string supports 34 to rotate counterclockwise, which adjusts the tension and pitch of the adjustable strings 20.

The pitch adjustment device 12 also comprises an adjustable actuation stop 42 for adjustably setting the actuated position by limiting the amount of pivoting of the lever 38 in the counterclockwise direction when actuated. The adjustable actuation stop 42 comprises a screw threaded into the lever 38 on the left side of the connection to the string puller 26 and extending out of the bottom of the lever 38 such that the bottom end of the hits a strike plate (e.g. base plate 28 or other plate) on the body 14 and stops the pivoting of the lever 38 in the actuated position. The actuated position of the lever 38 is adjusted by screwing the screw into or out of the lever 38 to set the desired actuated position for the lever 38.

An adjustable open tuning stop 44 is also provided to set the position of the lever in the normal position by limiting the pivoting movement of the lever in the clockwise direction. The adjustable open tuning stop 44 comprises a screw threaded into the lever 38 on the right side of the connection to the string puller 26 and extending out of the bottom of the lever 38 such that the bottom end of the hits a strike plate (e.g. base plate 28 or other plate) on the body 14 and stops the pivoting of the lever 38 in the normal position. The normal position of the lever 38 is adjusted by screwing the screw into or out of the lever 38 to set the desired normal position for the lever 38.

One or more counterbalancing springs 46 are provided to counteract the forces (including torque) on the pitch adjusters 32, string puller 26 and lever 38 caused by the tension of the adjustable strings 20 being attached to the pitch adjusters. In the embodiment of FIGS. 1-3, the counterbalancing springs 46 are tension springs (i.e., the spring is in tension and the ends pull toward the center of the spring) with a first end coupled to a respective pitch adjusters 32 and a second end coupled to a spring support 48 which is mounted to the body 14 of the steel guitar 10. The first end of each of the counterbalancing springs may be coupled to its respective pitch adjusters 32 by a loop on the first end being received on the pitch adjuster 32. The second end of each of the counterbalancing springs may be attached to the spring support 48 using a screw or other attachment device. The amount of counterbalancing force may be adjusted by adjusting the screw to increase or decrease the length and force of the counterbalancing springs 46.

Alternative to the springs 46 comprising one or more tension springs, or in addition, the device 12 may utilize a lever counterbalance 50 comprising a compression spring 49 coupled to the lever 38 to counteract the tension of the adjustable strings 20. The compression spring 49 positioned on the right side of the connection of the lever 38 to the string puller 26. The compression spring 48 is inset into the body 14 and an adjustment screw 51 is threaded into the lever 48 and extends out of the bottom of the lever 38 and bears on the compression spring 49. The amount of counterbalancing force may be adjusted by adjusting the adjustment screw 51.

The counterbalancing springs 46 and/or lever counterbalance 50 are adjusted so that there is a net force from the string tension biasing the lever 38 and spring puller 26 to the normal position, such that upon release of the lever 38 when in the actuated position, the lever 38 and spring puller 26 return to the normal position by the net force.

The lever 38 may also have a releasable locking device 52 for releasably locking the lever 38 in the actuated position. The releasable locking device 52 may be any suitable latch, magnet, fastener, detents, cam follower, pen click mechanism, or the lock for releasably locking the lever 38 in the actuated position. For example, a pen click mechanism can be pushed once to lock the lever 38 in the actuated position, and upon pushing the lever a second time, the pen lock mechanism releases the lever 38 so it returns to the normal position. The locking device 52 may alternatively be a detent or latch in which the lever 38 may pivotable (e.g. may be swiveled) about an axis perpendicular to the first axis 27, such as a vertical axis in the orientation of the lever in FIGS. 1-3. In other words, the lever 38 can be swiveled toward and away from the player about the vertical axis. In one way, the lever 38 may be attached to the string puller 26 by a ball and socket joint with a vertical pin retaining the ball in the socket and the vertical pin defining the vertical axis about which the lever 38 can swivel. The lever 38 is provided with a latch or detent and the body 14 of the guitar 10 is provided with a mating catch. In operation, the lever 38 is pivoted to the actuated position with the lever 38 in an unswiveled orientation about the vertical axis. With the lever 38 in the actuated position, the lever 38 is swiveled about the vertical axis (either toward or away from the player, depending on the configuration of the latch and catch) to mate the latch or detent on the lever 38 with the mating catch on the body 14. This locks the lever 38 in the actuated position. Then, to release the lever 38, the lever 38 is simply swiveled in the opposite direction to release the latch from the catch, and the lever 38 returns to the normal position by the biasing force as described herein.

The operation of the pitch adjustment device 12 will now be described. The steel guitar 10 and pitch adjustment device 12 must first be tuned to the proper open tuning and adjusted tuning (tuning with the device 12 actuated). First, each of the strings 20, including the adjustable strings 20, are tuned to their desired open pitch with the lever in the normal position. The string 20 which requires the least amount of length adjustment in order to adjust the string's pitch from the open pitch to the adjusted pitch is tuned for the adjusted pitch first (referred to as the first adjustable string). The tuning is facilitated by having the pitch adjuster 32 for such string 20 set with its string support 34 at its minimum radial distance from the first axis 27 (in other words, the string support 34 is positioned closest to the spring puller 26). Then, with the lever 38 pivoted to the fully actuated position set by the adjustable actuation stop 42, and the adjustable actuation stop 42 is adjusted to tune the first adjustable string 20 to its desired adjusted pitch (i.e. adjusting the adjustable actuation stop adjusts the amount of rotation of the pitch adjuster 32 for the first adjustable string thereby adjusting the pitch). Next, the second adjustable string 20 which requires more length adjustment to go from its open pitch to its adjusted pitch is tuned to its desired adjusted pitch with the lever 38 in the actuated position as just set while tuning the first adjustable string. The second adjustable string 20 is tuned by adjusting the radial distance of its respective string support 34 to tune the second adjustable string 20 to its desired adjusted pitch. Any additional adjustable string 20 are tuned in the same manner as the second adjustable string 20.

Now, the steel guitar 20 is ready to be played utilizing the pitch adjustment device 12. To play the steel guitar 10 with the adjustable strings 20 in their open pitch, the player simply leaves the lever 38 in the normal position. When the player desires to modify the pitch of the adjustable strings 20, such as to change the tuning of the steel guitar from one key to a different key, the player pushes the lever 30 to the actuated position by pivoting the lever downward which rotates the string puller 26, the pitch adjusters 32, the string supports 34 which moves the tail end of the adjustable strings 20, thereby modifying the length, and thus the tension and pitch, of the adjustable strings 20. When the player desires to return to the open tuning of the steel guitar 10, the player releases the lever 38, and the net biasing force pivots the lever 38 back to the normal position which in turn rotates the string puller 26, the pitch adjusters 32, the string supports 34 and the tail end of the adjustable strings 20 to their unadjusted position for the open tuning of the steel guitar.

Figure 4:
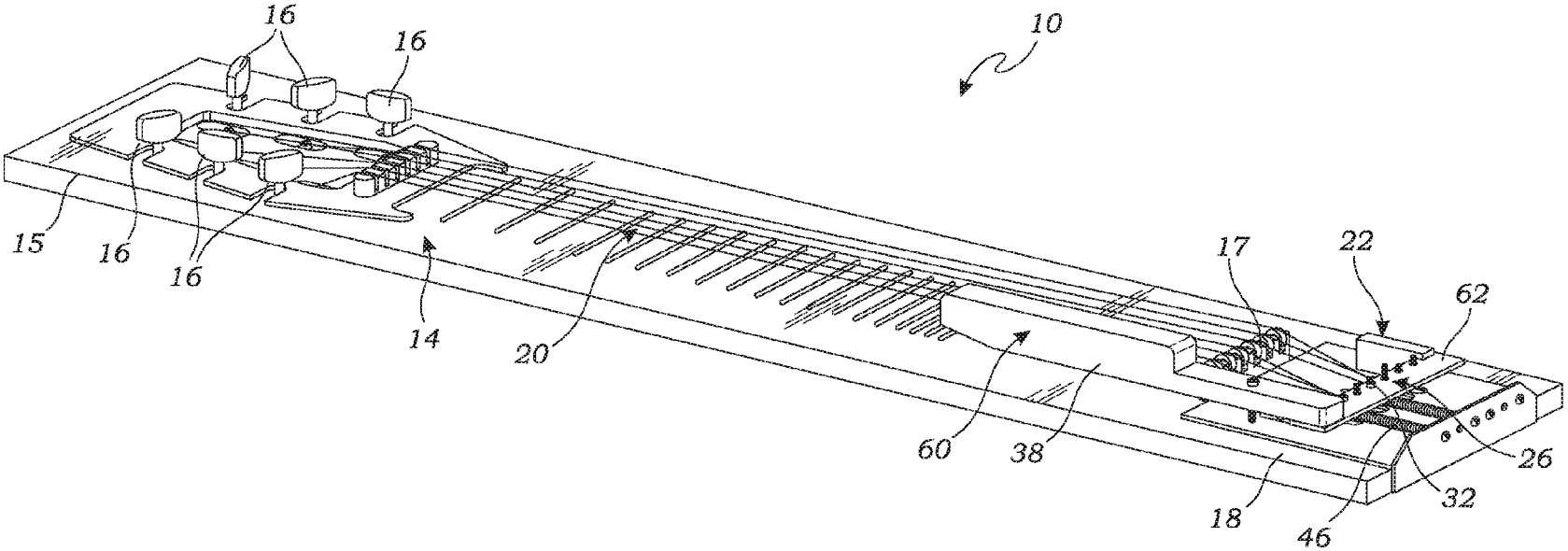
FIG. 4 is a side perspective view of an exemplary steel guitar having a pitch adjustment device, according to another embodiment of the present invention.
Figure 5:
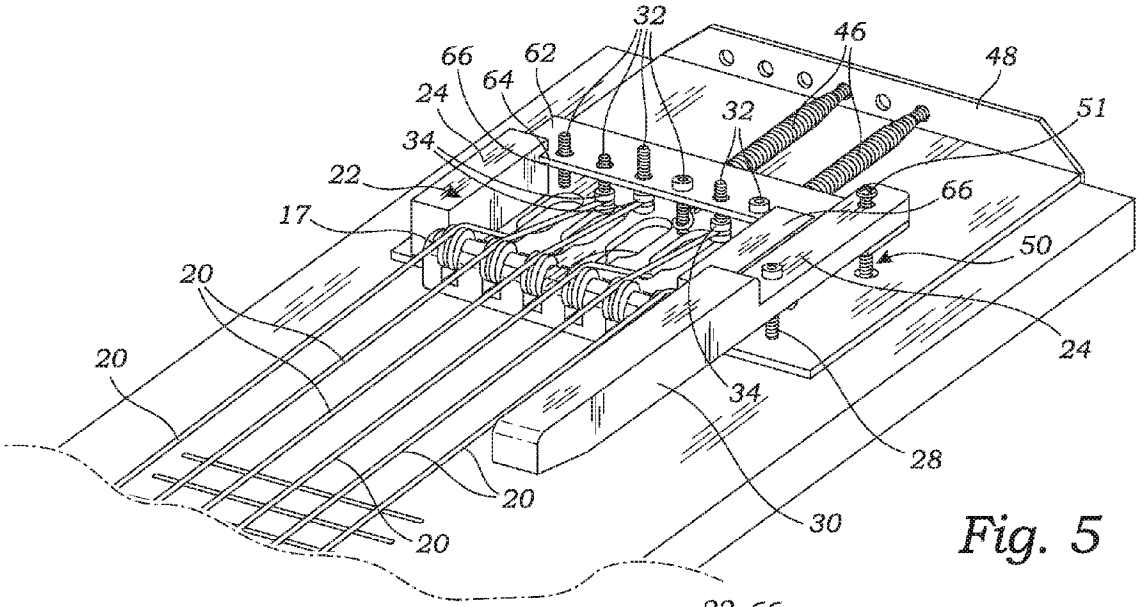
FIG. 5 is an enlarged partial side perspective view of the steel guitar and pitch adjustment device of FIG. 4.
Figure 6:
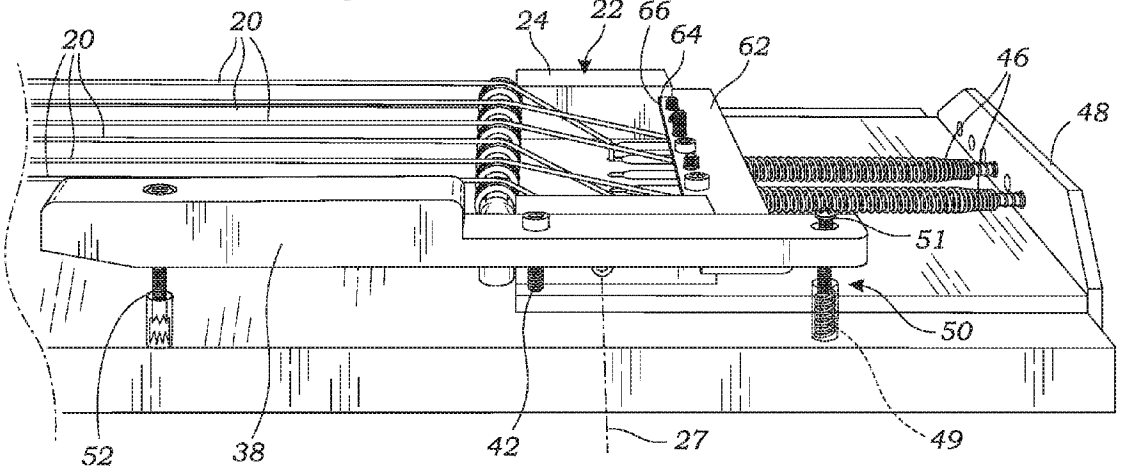
FIG. 6 is an enlarged side view of the steel guitar and pitch adjustment device of FIG. 4.

Turning now to FIGS. 4-6, a steel guitar 10 having another embodiment of a pitch adjusting device 60 is illustrated. The steel guitar 10 and the pitch adjusting device 60 of the embodiment of FIGS. 4-6 is very similar to the embodiment of FIGS. 1-3 described above, and like reference numerals refer to like elements. Furthermore, the description above for the like elements, features, and operation of the embodiment of FIGS. 1-3 described above shall apply equally to the embodiment of FIGS. 4-6. Thus, only the different elements, features and operations of the embodiment of FIGS. 4-6 will now be described.

The main difference between the pitch adjusting device 60 and the pitch adjusting device 12 is the use of a plate 62 for the string puller 26 instead of the shaft 30. Thus, the pitch adjusting device 60 comprises a string puller 26 which in turn comprises an elongated, substantially flat plate 62. The plate 62 has a pair of pivot members 64, one on each end of the plate 64. The pivot members 64 are tapered surfaces on the forward edge of the plate 62, such as a sharp edge or knife edge to reduce friction and provide a pivot about which the plate 62 can rotate. The pivot members 64 are received in a respective pivot surface 66 in each of the puller mounts 24. Each pivot surface 66 is an arcuate wall surface formed in the respective puller mount 24. The interface of the pivot members 64 and the pivot surfaces 66 define the first axis 27 about which the plate 64 rotates.

The pitch adjusters 32 are attached to the plate 62 by threaded screws which are threaded into a mating threaded hole in the plate 30 of the string puller 26. The centerline of the pitch adjusters 32 is located on first axis 27.

Otherwise, the operation, elements, and features of the embodiment of FIGS. 4-6 is the same as described above for the pitch adjusting device 12 of the embodiment of FIGS. 1-3.

Figure 7A:
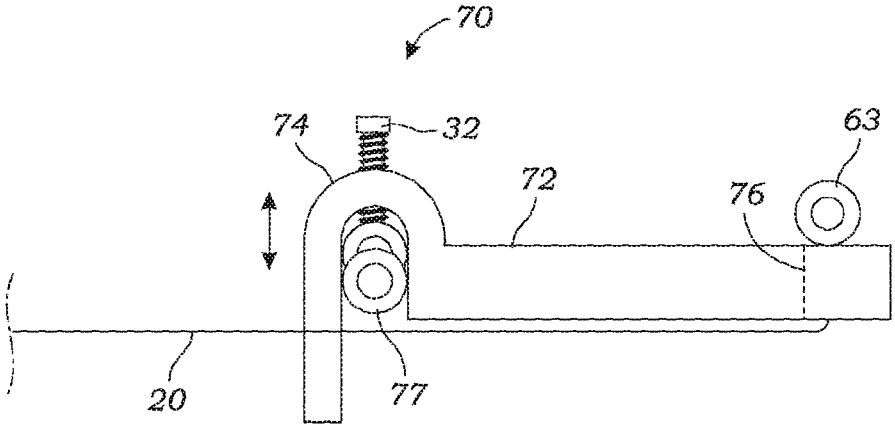
FIG. 7A-7C are an enlarged side view an enlarged front view and an enlarged top view of an alternative plate design for a pitch adjustment device, according to still another embodiment of the present invention.
Figure 7B:
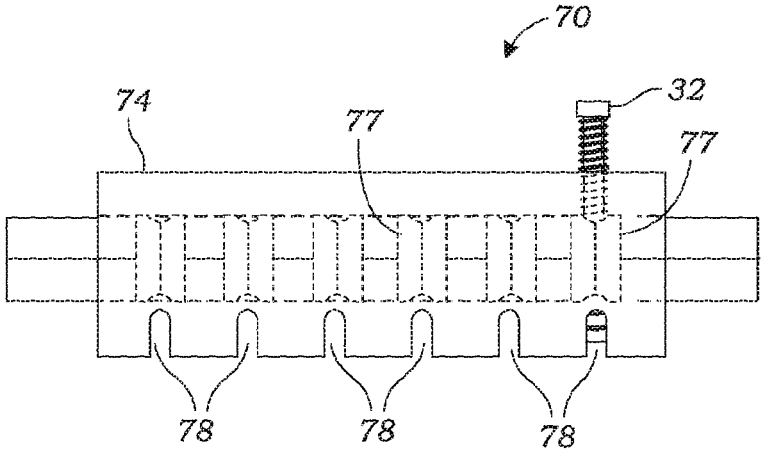
Figure 7C:
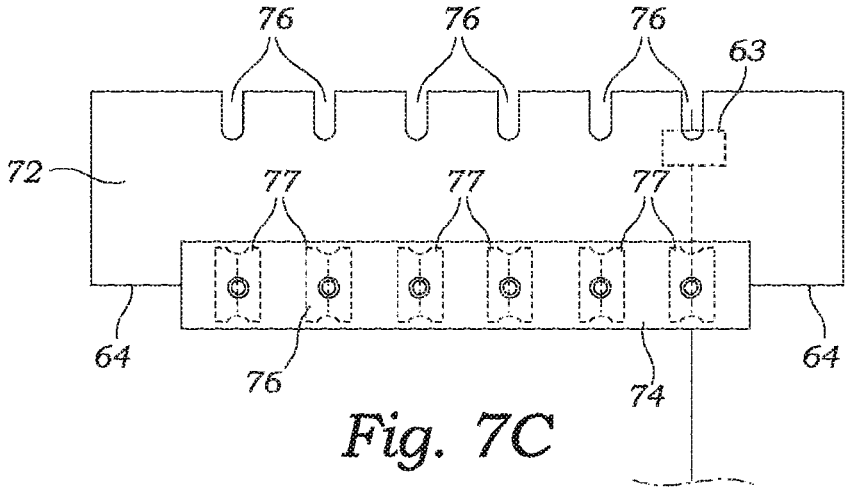

Turning now to FIGS. 7A, 7B and 7C, an alternative embodiment for the plate 64 of the pitch adjustment device 60 and pitch adjusters is shown. The plate 70 includes a main plate 72 which is substantially the same as plate 64 described above. The main plate 72 includes a plurality of string support slots 76 configured to receive and secure the ball end 63 of the adjustable strings 20. A front plate 74 is attached to the front edge of the main plate 72. The front plate 74 forms a gap in which string rollers 76, one for each adjustable string, are located. The front plate also has a string guide slot 78 for each adjustable string 20 in alignment with the respective string 20. The pitch adjusters 80 also have a different design for this embodiment of the plate 70. Instead of a string support 34, each pitch adjuster 80 has a string roller 77 attached to the end of the screw. Adjustment of the pitch adjuster 80 adjusts the radial distance of the string roller 77 from the first axis, thereby adjusting the length, tension and pitch of the adjustable string 20. Otherwise, the plate 70 operates substantially the same as the plate 64, and a pitch adjustment device 60 having the plate 70 operates substantially the with the plate 64.

Figure 8A:
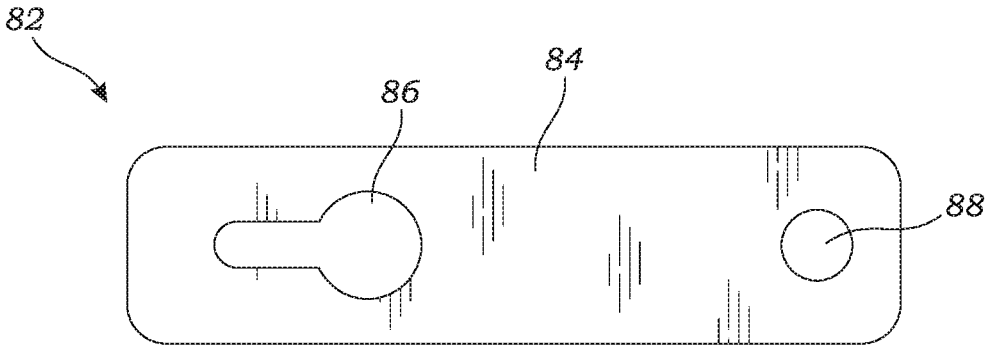
FIG. 8A is an enlarged top view of a string extender which can be used with the pitch adjustment devices, according to yet another embodiment of the present invention.
Figure 8B:
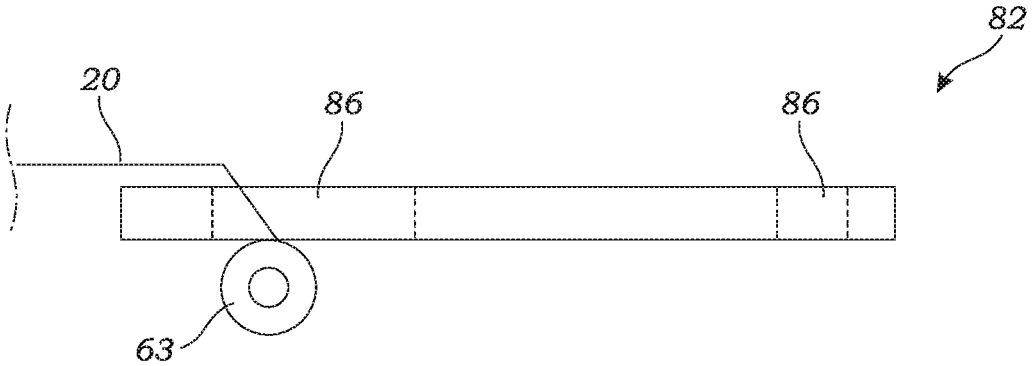
FIG. 8B is an enlarged side view of the string extender of FIG. 8A.
Figure 8C:
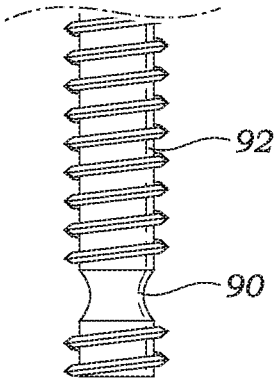
FIG. 8C is an enlarged side view of a pitch adjuster screw for use with the string extender of FIGS. 8A and 8B.

Referring now to FIGS. 8A and 8B, a string extender 82 is shown which can be used as an accessory for the pitch adjustment devices of FIGS. 1-3 and FIGS. 4-6. For example, in the case that a pitch adjuster 32 is configured to lower the pitch of an adjustable string 20 in the actuated position, the head of the screw is below the string puller 26 and the string support is above the string puller 26. Accordingly, it may be difficult to adjust the pitch adjuster 26 because there is insufficient room to access the head of the screw. The string extender 80 allows provides a device to secure the adjustable string 20 and allow adjustment of the radial distance of the string 20 from the first axis 27 without reversing the orientation of the screw (i.e. the head of the screw is above the string puller 26). The string extender 80 comprises an elongated plate 84 having a ball retainer opening 86 on one end and a hole 88 on the other end. The ball retainer opening 86 has a larger ball hole through which the ball 63 can be inserted and a connecting slot which is narrower such that it does not allow the ball 63 to pass through. The hole 88 is configured to be received on a groove 90 on the screw 92 adjacent the head 94 of the screw 92. The pitch adjuster 32 then comprises the screw 92 and the string extender 80. The pitch adjuster 32 is attached to the string puller 26 by first placing the hole 88 of the string extender 80 onto the groove 90 of the screw 92. The screw 92 is then threaded into the string puller 26 with the head 94 and the string extender 80 above the string puller 26. The ball 63 of an adjustable string 20 is simply inserted the ball retainer opening 86. The string extender 80 can be used on either of the embodiments of pitch adjustment devices 12 and 60.

Figure 9:
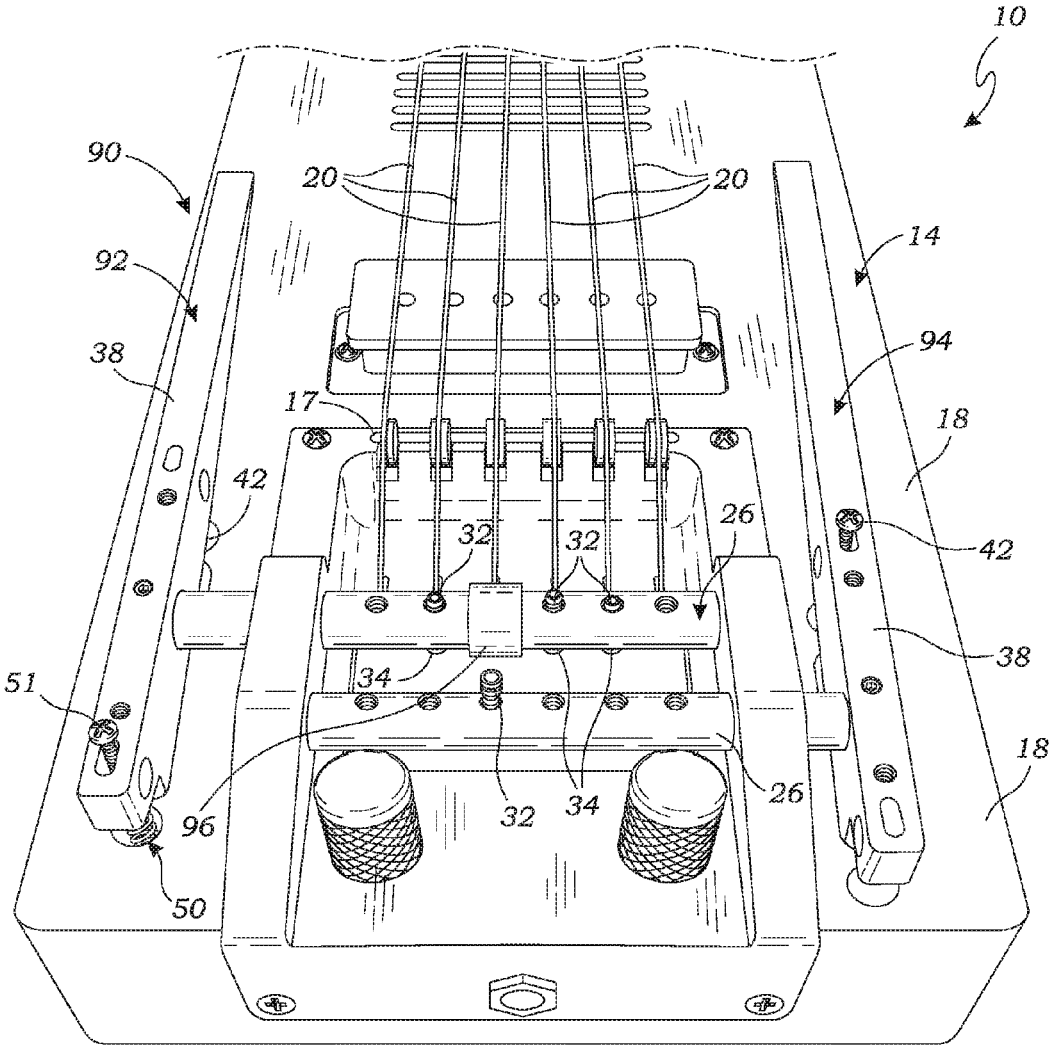
FIG. 9 is an enlarged side perspective view of a steel guitar having two pitch adjustment devices, according to another embodiment of the present invention.
Figure 10:
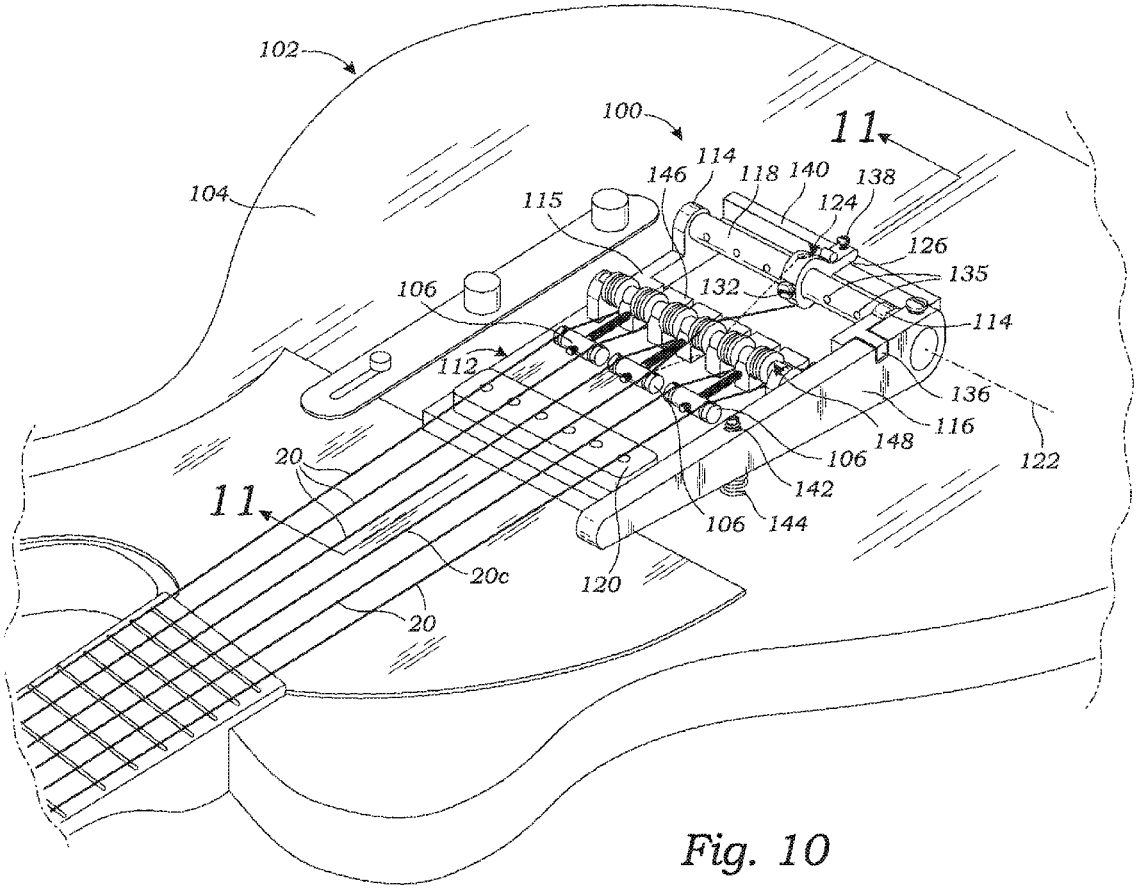
FIG. 10 is a side perspective view of an exemplary electric guitar having a pitch adjustment device, according to another embodiment of the present invention.

Turning now to FIG. 9, a steel guitar 10 having another embodiment of a pitch adjusting system 90 is illustrated. The pitch adjusting system 90 comprises two pitch adjustment devices 92 and 94, each of which can be any of the pitch adjusting devices 12 or 60, and can include any of the elements and features, as described above. The first pitch adjusting device 92 and second pitch adjusting device 94 are substantially the same except that the first axis 27 of the first pitch adjusting device 92 is offset from the first axis 27 of the second pitch. Also, the lever 38 of the second pitch adjusting device 94 is located on the top side of the string puller 26 of the second pitch adjusting device 94. The puller mounts 24 of each pitch adjusting device 92 and 94 may be integrally formed as shown in the exemplary embodiment of FIG. 9, or they may each have separate puller mounts 24. Each of the adjustable strings 20 is attached to a pitch adjuster 32 of only one of the pitch adjustment devices 92 or 94. The first pitch adjustment device 92 which is forward of the second pitch adjustment device 94 may have a string guide 96 for guiding an adjustable string 20 past the string puller 26 on the first pitch adjustment device 92 to the string puller 26 on the second pitch adjustment device 94.

The pitch adjusting system 90 is operated in the same manner for each of the pitch adjusting devices 92 and 94, as described above, except that when in use while playing the steel guitar 10, none, either one, or both pitch adjusting devices 92 and 94 can be actuated to achieve a desired tuning of the steel guitar 10.

Turning now to FIGS. 10-15, a second embodiment of a pitch adjustment device 100 is shown mounted on a conventional electric guitar 102. It is understood that the pitch adjustment device 100 may be used on any suitable stringed instrument, including without limitation, a steel guitar, an acoustic guitar, other types of guitars, etc.

The electric guitar 102 comprises a body 104, a neck 106 extending from the body 104 to a headstock (not shown), and a plurality of strings 20 (in this example, the electric guitar has 6 strings). The headstock has tuning keys (not shown), one for each string of the guitar 102. The head end of each string 20 is operatively coupled to a respective tuning key (not shown). The tuning keys are operably attached to the headstock or a key frame of the headstock such that such that each tuning key can rotate relative to the headstock to adjust the tension, and thus pitch, of its string 20. The strings 20 extend rearward from the tuning keys and pass over and are supported by a bridge 106. The bridge 106 may be a component of the pitch adjustment device 100, or it may be a separate component, or the original bridge of the electric guitar 102. The tail end of each string 20 is operatively coupled to the pitch adjustment device 100 which is attached to the body 104 of the guitar 102. The pitch adjustment device 100 may be attached to the body 104 by any suitable fastening mechanism, such as screws, bolts, press fit, adhesive, bonding, etc. In addition, the individual components of the pitch adjustment device 100 may be individually attached to the body 104, or they may be attached to one or more structural elements which are attached to the body 104. If used as a retrofit of the original tail piece of an electric guitar, the original tail piece, such as the bridge and/or pickups 120 maybe removed. Then, the pitch adjustment device 100 can be mounted in place of the original bridge and/or pickup 120. The mounting holes for the pitch adjustment device 100, such as mounting holes provided in the support frame 108 (described below) can be configured to match the mounting holes of the original bridge and/or pickup 120 so that no additional holes in the body are required.

The pitch adjustment device 100 comprises a support frame 112. The support frame 112 includes a base plate 115 which is a substantially flat plate which sits on the body 104 when the support frame 112 is mounted to the body 104 of the guitar 102. The support frame 112 also has a pair of puller mounts 114, one located on the bottom side of the strings and one located on the top side of the strings 20 (the top side of the strings 20 is the side nearest the lever 116, and the bottom side of the strings 20 is on the other side of the bottom-most string 20). The puller mounts 114 extend upward away from the base plate 115, and are configured to rotatably support a string puller 118.

The string puller 118 is rotatably coupled to the puller mounts 24 with one puller mount 114 disposed on each end of the string puller 118. The string puller 118 has a longitudinal first axis 122 about which the string puller 118 rotates and which is substantially transverse to the longitudinal axis of the strings 20.

In the illustrated embodiment, the string puller 118 comprises an elongated, substantially circular shaft. The shaft may have any suitable alternative cross-sectional shapes, such as square, rectangular, etc. The string puller 118 has a circular bearing surface on each end of the shaft which is received in a respective circular bearing hole (e.g. bearing race) in the puller mounts 118.

A string support 124 is coupled to the string puller 118 such that it rotates with rotation of the string puller 118. The string support 124 comprises a body 123 having a rod receiving hole 125 which slidably receives the cylindrical rod of the string puller 118. The string support 124 is adjustably positionable along the longitudinal axis of the string puller 118 by simply sliding the string support 124 along the string puller 118. In this way, the string support 124 can be selectively positioned on the string puller 118 in corresponding alignment with each of the strings 20, one at a time. In other words, the string support 124 can be positioned in alignment with every one of the strings 120, but one at time. Thus, the string support 124 is positioned in alignment with a selected string 20 (in the illustrated embodiment, string 20*c*) and the pitch of the selected string 20*c* will be adjustable using the pitch adjustment device 100. Once the string support 124 is properly positioned along the string puller 118, a set screw 132 extending through a set screw hole 134 in the string support 124 is fastened to the string puller 118, such as by screwing the set screw into a threaded hole 135 in the string puller 118. Thus, the string puller 118 may have a plurality of threaded holes 135 located to position the string support 124 in alignment with a respective one of the strings 20.

Figure 13:
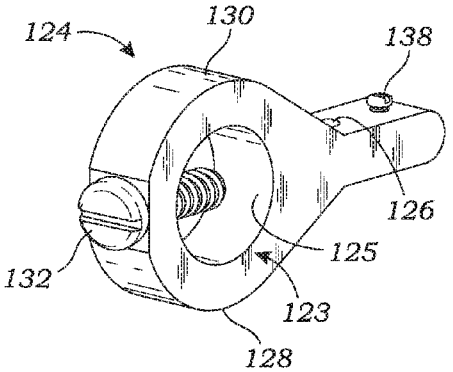
FIG. 13 is a side, perspective view of a string support, according to one embodiment of the present invention.
Figure 14:
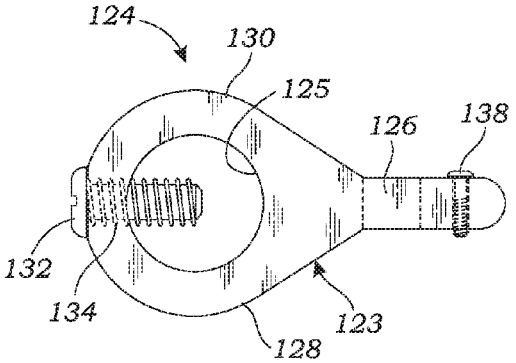
FIG. 14 is a side view of the string support of FIG. 13.
Figure 15:
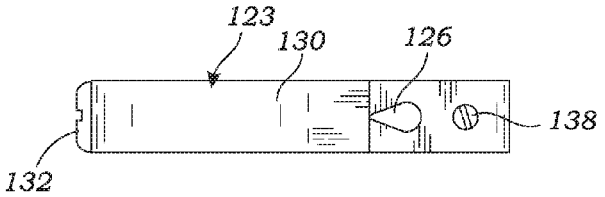
FIG. 15 is a top view of the string support of FIG. 13.

Turning to FIGS. 13-15, the string support 124 has a string retainer 126 for securing a tail end of the selected string 20*c* to the string support 124. The string retainer 126 may comprise a string retainer hole extending completely through a back portion of the body. The string retainer hole has a first portion have a large cross-section through which a ball-end of a musical string fits entirely through the hole and a second portion have a smaller cross-section which is smaller than the large cross-section such that the ball-end will not fit. For example, the string retainer hole may have a pear-shaped cross-section, as shown in the illustrated embodiment of FIGS. 13-15.

The string support 124 also comprises a first string contact surface 128 which contacts and supports the adjustable string 20*c* when the adjustable string 20*c* is positioned to the bottom side of the string support 124, below the first axis 122. As described below, positioning the adjustable string 20*c* to the bottom side of the string support 124 configures the pitch adjustment device 100 for a "raise" adjustment such that rotation of the string puller 118, string support 124 (and lever 116) in a first direction (actuation direction) from a normal position to an actuated position increases the tension and thus, the pitch, of the adjustable string 20*c*. The first string contact surface 128 is configured to be the part of the string support 124 which first contacts and supports the tail end of the adjustable string 20*c* as the adjustable string 20*c* extends from the bridge to the string support, when the adjustable string 20*c* is positioned on the bottom side of the string support 118. The first string contact surface 128 is disposed vertically below the first axis 122. The first string contact surface 128 has a cross-section which is substantially in the shape of a circular arc rotated about the first axis, such that the contact surface is a partial cylindrical surface. This smooth contact surface minimizes the stress on the adjustable string 20*c* and can reduce string breakage.

The string support 124 also has a second string contact surface 130 which contacts and supports the adjustable string 20*c* when the adjustable string 20*c* is positioned to on the top side of the string support 124, above the first axis 122. As described below, positioning the adjustable string 20*c* to the top side of the string support 124 configures the pitch adjustment device 100 for a "lower" adjustment such that rotation of the string puller 118, string support 124 (and lever 116) in a first direction from a normal position to an actuated position decreases the tension and thus, the pitch, of the adjustable string 20*c*. The second string contact surface 130 is configured to be the part of the string support 124 which first contacts and supports the tail end of the adjustable string 20*c* as the adjustable string 20*c* extends from the bridge to the string support, when the adjustable string 20*c* is positioned on the top side of the string support 124. The second string contact surface 130 is disposed vertically above the first axis 122. The second string contact surface 130 has a cross-section which is substantially in the shape of a circular arc rotated about the first axis, such that the contact surface is a partial cylindrical surface.

As described above, the string support 124 also has a set screw 132 which extends through a set screw hole 134 extending from a front side of the body to the string puller receiving hole 125. The set screw hole 134 and set screw 132 may be located between the first and second string contact surfaces 128 and 130, and oriented parallel to the longitudinal axis of the strings.

The string support 124 also has an adjustable open stop 138. The adjustable open stop 138 comprises an open stop screw threaded into a threaded hole in the back side of the body 123. The adjustable open stop 138 is positioned so that it bears against a stop ledge 140 extending upward from the base plate 115. The adjustable open stop 138 can be used to adjustably set the position of the lever 116, string puller 118 and string support 124 in the normal position of the lever (de-actuated position) by limiting their rotation in a second direction (de-actuation direction) opposite the actuation direction.

The lever 116 is coupled to the string puller 118 such that pivoting (i.e., rotating) the lever 116 rotates the string puller 118 and the string support 124. The lever 116 is attached to the top end of the string puller 118 such that it is located near the palm of a musician playing the guitar 102 and is oriented longitudinally substantially parallel to the longitudinal axis of the strings 20 when the pitch adjustment device 100 is mounted on the guitar 102. The lever 116 has a normal position in which the lever 116 is not being actuated (i.e., the adjustable string 20*c* is in the open pitch) and an actuated position in which the lever 116 is pivoted in the first direction from the normal position (i.e., the adjustable strings are in an adjusted pitch). In the illustrated embodiment, the normal position of the lever 116 is rotated fully in an upward direction ("upward" being away from the body 104 of the guitar 102) until it bears against an open stop 136 which limits the upward pivoting of the lever 116. Alternatively, or additionally, the adjustable open stop 138 can be used to set the de-actuated position of the lever 116.

An adjustable actuation stop 142 is provided on the lever in order to adjustably limit the pivoting of the lever 116 in the first direction (actuation direction). The adjustable actuation stop 142 comprises a screw threadingly engaged in the lever 116 such that adjusting the screw adjusts the position at which the adjustable actuation stop 142 limits the pivoting of the lever 116 in the first direction (actuation direction).

Figure 11:
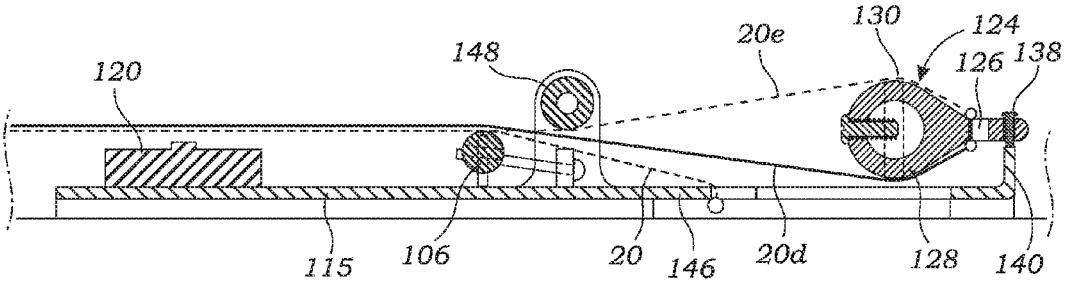
FIG. 11 is a side, cross-sectional view of the pitch adjustment device of FIG. 10.
Figure 12:
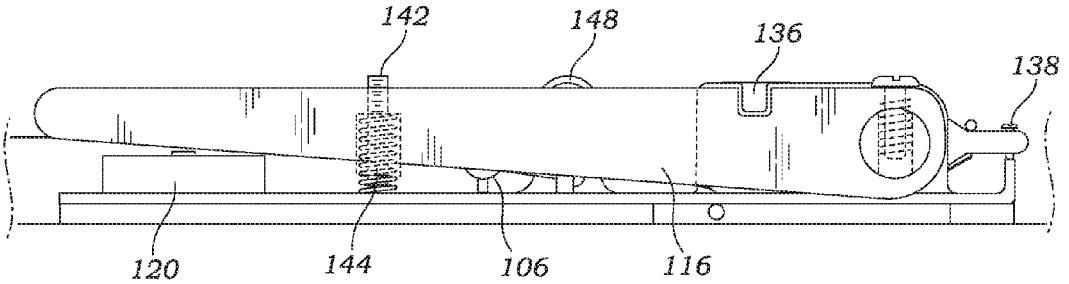
FIG. 12 is a side, side view of the pitch adjustment device of FIG. 10.

The pitch adjustment device 100 may be set-up to raise or lower the pitch of the adjustable string 20*c* when depressing the lever 116 from the normal position to the actuated position, depending on how the string 20*c* is positioned on the string support 124. As best shown in FIG. 11, in order to set-up for a "raise" adjustment, the adjustable string 20*c* is positioned as shown for the string 20*d*, with the string 20*d* positioned on the bottom side of the string support 124 such that the string 20*d* contacts the first string contact surface 128. Then, when the lever 116 is depressed causing it to pivot downward, the string puller 118 and string support 124 rotate in the first direction (actuation direction) which increases the tension and raises the pitch of the string 20*d*. In order to set-up for a "lower" adjustment, the adjustable string 20*c* is positioned as shown for the string 20*e*, with the string 20*e* positioned on the top side of the string support 124 such that the string 20*e* contacts the second string contact surface 130. Then, when the lever 116 is depressed causing it to pivot downward, the string puller 118 and string support 124 rotate in the first direction (actuation direction) which decreases the tension and raises the pitch of the string 20*e*.

In the "raise" configuration, the tension of the string 20*c* provides a biasing force which biases the string support 124, string puller 118 and lever 116 to the normal position (de-actuated position), such that the rotation is at the limit of the open stop 136 and/or 138. However, in the "lower" configuration, the tension of the string 20*c* biases the string support 124, string puller 118 and lever 116 toward the actuated position. In this case, a biasing spring 144 is provided between the lever 116 and the base plate 115 with the spring 144 in compression so that it forces the lever 116 to the normal position. The spring 144 may be retained on the actuation stop 142, or by another retaining device.

In addition, in the "lower" configuration with the adjustable string 20*c* positioned on top of the string support 124, the adjustable string 20*c* could be lifted above the bridge 106, which would change the vibrating length of the string 20*c*. Accordingly, a string positioner 148 is positioned between the bridge 106 and the string puller 118 and is configured to push down on an adjustable string 20*c* which is positioned on the top side of the string support 118 such that the string 20*c* remains in contact with the bridge 106. The string positioner 148 comprises a plurality of rollers, wherein each roller is positioned in alignment with a respective string 20. The bottom of the rollers is positioned at a height above the plane of the strings (or the plane of the base plate 115) which is lower than the height of the top of the string support 124.

It can be seen that the pitch adjustment device 100 may also comprise two or more string supports 124 coupled to the string puller 118 by simply installing two or more string supports 124 onto the string puller 118. Each string support 124 has the features as described herein, and is independently adjustably positionable along the longitudinal axis of the string puller 118. Then, each string support 124 is positioned in alignment with a respective, selected string, such that multiple strings may be adjustable using the pitch adjustment device 100.

A string holder 146 is also provided on the support frame 112 in order to secure the tail end of each of the strings 20 other than the adjustable string 20*c*. The string holder 146 comprise a plate having a respective slot or hole in alignment with each respective string. The slots or holes are configured to retain a ball-end of a musical string.

The string support 124 may be configured for use the pitch adjustment device 12, described above. For instance, one or more of the pitch adjusters 32 in the pitch adjustment device 12 may be left off the device, and one or more string supports 124 of are coupled to the string puller 26 of the pitch adjustment device 12 such that string support(s) 124 are adjustably positionable along the longitudinal axis of the string puller 26. The resulting pitch adjustment device may then be set-up and utilized as described above. One or more first selected strings 20 may be secured to a string support 34 of a pitch adjuster 32, and a second selected string(s) 20 is secured to the string support 124. The first selected strings 20 may then be tuned using the procedure described above for the pitch adjustment device 12, and the second selected string(s) 20 may be tuned using the procedure described for the pitch adjustment device 100. The resulting pitch adjustment device is utilized by a player while playing as described for either one of the first and/or second embodiments.

The set-up and operation of the pitch adjustment device 100 will now be described. The pitch adjustment device 100 is mounted to a stringed instruments, such as by mounting the support frame 112 to the body 104 of a guitar 102 using suitable fasteners such as screws or bolts. For a retrofit installation, the original bridge and/or pickup may be removed, and then the pitch adjustment device can be mounted in place of the original bridge and/or pickup. The mounting holes of the support frame 112 can be configured to match the mounting holes of the original bridge and/or pickup so that no additional holes in the body are required.

The string support 124 is then positioned in alignment with a selected one of the strings 20*c*, which string will be adjustable using the pitch adjustment device 100. The string support 124 is then secured in place using the set screw 132. The adjustable string 20*c* is positioned on the bridge 106 and the tail end of the adjustable string 20*c* is positioned on either the top of the string support 124 of the bottom of the string support 124 and is secured to the string retainer 126. The respective tail end of each of the other strings 20 is secured to the string holder 146. With the lever 116 in the normal position (the lever 116 is biased to the normal position by the string tension and/or biasing spring 144), the instrument is tuned to a desired open tuning with each string tuned to its open pitch. Then, the lever 116 is actuated by pivoting the lever 116 in a first direction (usually downward) to the actuated position until the pivoting is stopped by the adjustable actuation stop 142. This either raises or lowers the pitch of the string 20*c*, depending on how the string 20*c* is positioned on the string support 124. The adjustable actuation stop 142 is then adjusted to tune the adjustable string 20*c* to the desired pitch with the lever 116 in the actuated position (i.e., pivoted to the limit of the actuation stop).

The pitch adjustment device 100 is then ready to be used by a player playing stringed instrument. When the open pitch of all strings is desired, player simply leaves the lever 116 in the normal position. When the player desires to modify the pitch of the adjustable string 20*c*, such as to change the tuning of the instrument from one key to a different key, the player actuates the lever 116 to the actuated position by pivoting the lever in the first direction which rotates the string puller 118, the string support 124 and the tail end of the adjustable string 20*c*, thereby modifying the length, and thus the tension and pitch, of the adjustable string 20*c*. When the player desires to return to the open tuning of the instrument, the player releases the lever 116, and the biasing force pivots the lever 116 back to the normal position which in turn rotates the string puller 118, the string support 124 and the tail end of the adjustable string 20*c* to their unadjusted, normal position for the open tuning of the instrument.

While embodiments of the present invention have been shown and described, various modifications may be made without departing from the scope of the present invention. The invention, therefore, should not be limited, except to the following claims, and their equivalents.

What is claimed is:

1. An apparatus for selectively adjusting the pitch of at least one of a plurality of strings on a stringed musical instrument comprising:

a support frame configured to be mounted onto the stringed musical instrument;

a string puller rotatably coupled to the support frame and rotatable about a first axis, the string puller having an exterior surface;

a pitch adjuster coupled to the string puller such that the pitch adjuster rotates with the rotation of the string puller, the pitch adjuster having a string support for securing a string at a string position, wherein the string support is positioned outside of the exterior surface of the string puller and the pitch adjuster is adjustable to adjust the string position relative to the string puller; and a lever coupled to the string puller such that pivoting the lever rotates the string puller and the string support relative to the frame about the first axis, the lever having a normal position in which the lever is not being actuated and an actuated position in which the lever is pivoted in a first direction from the normal position.

2. The apparatus of claim 1, wherein the pitch adjuster is adjustable to adjust the string support to a plurality of different radial positions from the first axis.

3. The apparatus of claim 2, further comprising an adjustable actuation stop which limits the pivoting of the lever in the first direction and being adjustable to adjust the actuated position at which the pivoting motion of the lever is limited.

4. The apparatus of claim 3, wherein the adjustable actuation stop comprises a screw threadingly engaged in the lever such that adjusting the screw adjusts the position at which the adjustable actuation stop limits the pivoting of the lever in the first direction.

5. The apparatus of claim 2, further comprising an adjustable open stop which limits the pivoting of the lever in a second direction opposite the first direction and being adjustable to adjusts the position of the lever in the normal position.

6. The apparatus of claim 5, wherein the adjustable open stop comprises a screw threadingly engaged in the lever such that adjusting the screw adjusts the position at which the adjustable open stop limits the pivoting of the lever in the second direction.

7. The apparatus of claim 2, wherein the string puller comprises a circular shaft having a circular bearing surface on each end of the shaft which are each received in a respective circular hole in the support frame.

8. The apparatus of claim 2, wherein the pitch adjuster comprises a screw threadingly attached to a threaded hole in the circular shaft, such that turning the screw adjusts the radial position of the string support.

9. The apparatus of claim 8, wherein the string support comprises a pin disposed at one end of the screw and configured to secure a ball end of the string.

10. The apparatus of claim 2, further comprising a counterbalancing spring coupled to one of the string puller or the lever and configured to bias the rotation of the string puller against a tension of the string when secured to the string support.

11. The apparatus of claim 1, wherein the string puller has a longitudinal axis configured to extend substantially transverse to a longitudinal axis of each of the strings of the stringed musical instrument; and the pitch adjuster is adjustably positionable along the longitudinal axis of the string puller to selectively position the pitch adjuster on the string puller in corresponding alignment with each of the strings one at a time.

12. The apparatus of claim 11, wherein the pitch adjuster comprises:

a first string contact surface disposed vertically below the first axis, the first string contact surface having a cross-section substantially in the shape of a circular arc rotated about the first axis; and a second string contact surface disposed vertically above the first axis, the second string contact surface having a cross-section substantially in the shape of a circular arc rotated about the first axis.

13. The apparatus of claim 12, further comprising a string positioner mounted to the frame, the string positioner configured such that when one of the plurality of strings is positioned on the second string surface and secured to the string support with tension on the string, the string roller pushes the string downward such that the string remains in contact with a bridge of the stringed instrument.

14. The apparatus of claim 12, wherein the pitch adjuster further comprises:

a hole for receiving the string puller such that the string support slides along the string puller; and a set screw extending through a front side of the string puller between the first string contact surface and second string contact surface, the set screw configured to screw into a threaded hole in the string puller in order to retain the string support in a fixed position along the string puller.

15. The apparatus of claim 14, wherein the pitch adjuster further comprises an adjustable open stop which limits the pivoting of the lever in a second direction opposite the first direction and which is adjustable to adjust the position of the lever in the normal position.

16. The apparatus of claim 14, further comprising an adjustable actuation stop disposed on the lever which limits the pivoting of the lever in the first direction and which is adjustable to adjust the position of the lever in the actuated position.

17. The apparatus of claim 11, further comprising an adjustable open stop which limits the pivoting of the lever in a second direction opposite the first direction and which is adjustable to adjust the position of the lever in the normal position.

18. The apparatus of claim 11, further comprising a counterbalancing spring coupled to one of the string puller or the lever and configured to bias the rotation of the string puller against a tension of the strings when secured to the string supports.

19. The apparatus of claim 1, further comprising a second pitch adjuster coupled to the string puller such that the second pitch adjuster rotates with the rotation of the string puller, the second pitch adjuster having a second string support for securing a second string at a second string position, the second string support positioned outside of the exterior surface of the string puller, wherein the second pitch adjuster is adjustable to adjust the second string position relative to the string puller.

20. The apparatus of claim 19, further comprising a counterbalancing spring coupled to one of the string puller or the lever and configured to bias the rotation of the string puller against a tension of the strings when secured to the string supports; the counterbalancing spring selected from the group consisting of: (a) a tension spring having a first end coupled to the string puller and a second end coupled to the support frame; and (b) a compression spring having a first end coupled to the lever and a second end configured to bear against a bearing surface installed on the stringed instrument.

21. The apparatus of claim 1, wherein the lever is coupled to a palm end of the string puller, the palm end being an end of the string puller which is configured to be closest to a palm of a musician when using the apparatus mounted on a stringed instrument.

22. The apparatus of claim 1, wherein the lever is configured to be located at a palm side of the strings of a stringed instrument in which the palm side of the strings is a side of the strings closest to the palm of a musician using the apparatus mounted on a stringed instrument.

23. An apparatus for selectively adjusting the pitch of at least one of a plurality of strings on a stringed musical instrument comprising:

a support frame configured to be mounted onto the stringed musical instrument;

a string puller rotatably coupled to the support frame and rotatable about a first axis the string puller having an exterior surface;

a pitch adjuster coupled to the string puller such that the pitch adjuster rotates with the rotation of the string puller, the pitch adjuster having a string support for securing a string at a string position, the string support positioned outside of the exterior surface of the string puller, wherein the pitch adjuster is adjustable to adjust the string support to a plurality of different radial positions from the first axis outside of the exterior of the string puller;

a lever coupled to the string puller such that pivoting the lever rotates the string puller and the string support relative to the frame about the first axis, the lever having a normal position in which the lever is not being actuated and an actuated position in which the lever is pivoted in a first direction from the normal position;

a counterbalancing spring coupled to one of the string puller or the lever and configured to bias the rotation of the string puller against a tension of the string when secured to the string support; the counterbalancing spring selected from the group consisting of: (a) a tension spring having a first end coupled to the string puller and a second end coupled to the support frame; and (b) a compression spring having a first end coupled to the lever and a second end configured to bear against a bearing surface installed on the stringed instrument.

24. The apparatus of claim 23, further comprising a second pitch adjuster coupled to the string puller such that the second pitch adjuster rotates with the rotation of the string puller, the second pitch adjuster having a second string support for securing a second string at a second string position, the second string support positioned outside of the exterior surface of the string puller, wherein the second pitch adjuster is adjustable to adjust the second string support to a plurality of different radial positions from the first axis outside of the exterior of the string puller.

* * * * *